United States Patent [19]

Bottoms

[11] 4,345,565

[45] Aug. 24, 1982

[54] FUEL PUMPING APPARATUS

[75] Inventor: Harry S. Bottoms, Henley in Arden, England

[73] Assignee: Lucas Industries Limited, Birmingham, England

[21] Appl. No.: 145,831

[22] Filed: May 1, 1980

[30] Foreign Application Priority Data

Dec. 7, 1979 [GB] United Kingdom ..... 7942372

[51] Int. Cl.[3] ..... F04B 49/06; F02M 39/00

[52] U.S. Cl. ..... 123/497; 123/467; 123/499

[58] Field of Search ..... 123/467, 499, 497

[56] References Cited

U.S. PATENT DOCUMENTS

| | | | |
|---|---|---|---|
| 3,921,604 | 11/1975 | Links | 123/499 |
| 3,965,876 | 6/1976 | Tissot | 123/467 |
| 4,276,000 | 6/1981 | Warwicker | 123/499 |
| 4,284,049 | 8/1981 | Chmela | 123/467 |

FOREIGN PATENT DOCUMENTS

| | | | |
|---|---|---|---|
| 2159332 | 6/1972 | Fed. Rep. of Germany | 123/467 |
| 2729826 | 1/1978 | Fed. Rep. of Germany | 123/467 |
| 1196663 | 11/1959 | France | 123/499 |
| 2444812 | 8/1980 | France | 123/499 |
| 1255652 | 12/1971 | United Kingdom | 123/467 |
| 266465 | 1/1971 | U.S.S.R. | 123/467 |

*Primary Examiner*—Raymond A. Nelli

[57] ABSTRACT

A fuel pumping apparatus for supplying fuel to an injection nozzle of an internal combustion engine comprises a pumping plunger housed in a bore and a piston connected to the plunger. Valve means constituted by a pair of sleeves is provided to control the application of fuel under pressure to the one or other side of the piston. The sleeve is movable and is connected to the output member of an electrically controlled actuating means. A spring is interposed between the piston and the output member so that during the return movement of the piston and plunger following delivery of fuel an increasing force will be applied by the spring to the output member to move the output member and sleeve in a direction to cut off the application of pressure to the piston. The final position of the piston and plunger will therefore depend on the force exerted by the actuating means which is a function of the magnitude of the electric current flowing therein.

6 Claims, 2 Drawing Figures

FUEL PUMPING APPARATUS

This invention relates to fuel pumping apparatus for supplying fuel under pressure to a fuel injection nozzle of an internal combustion engine, the apparatus comprising a plunger reciprocable within a bore, a piston connected to the plunger and of larger diameter than the plunger, valve means operable to apply a fluid under pressure to one surface of the piston to effect movement of the piston and the plunger thereby to cause fuel contained within the bore to be delivered to the injection nozzle, and electrically controlled actuating means for the valve means.

Such apparatus is known in the art and one of the difficulties of the known apparatus is the control of the extent of the return movement of the plunger and piston in order to determine the amount of fuel which is delivered to the injection nozzle. It is known to rely on a return spring to return the plunger and piston and so arrange the valve means and the actuating means that the piston and plunger can be hydraulically locked when the desired movement has taken place. With this arragement it is necessary to provide a transducer for proper control, the transducer providing an indication of the extent of the return movement of the piston and plunger. The provision of the transducer adds to the complexity of the apparatus and in addition the return spring must be sufficiently strong to return the plunger and piston in the short time available between the delivery strokes of the apparatus.

The object of the present invention is to provide a fuel pumping apparatus of the kind specified in a simple and convenient form.

According to the invention in an apparatus of the kind specified the piston is constructed as a double acting piston and the valve means is movable from an intermediate position in which the supply of fluid under pressure to the opposite ends of the cylinder containing the piston is prevented, towards one or other operating positions in which fluid under pressure is supplied to one end of the cylinder and allowed to escape from the other end of the cylinder and vice versa, the apparatus further comprising resilient means acting between the piston and an output member of the actuating means, the arrangement being such that the extent of the return movement of the piston and plunger following delivery of fuel, is determined by the force generated by the actuating means and which is at least in part, opposed by the force exerted by the resilient means.

An example of an apparatus in accordance with the invention will now be described with reference to the accompanying drawings in which.

Figure 1:
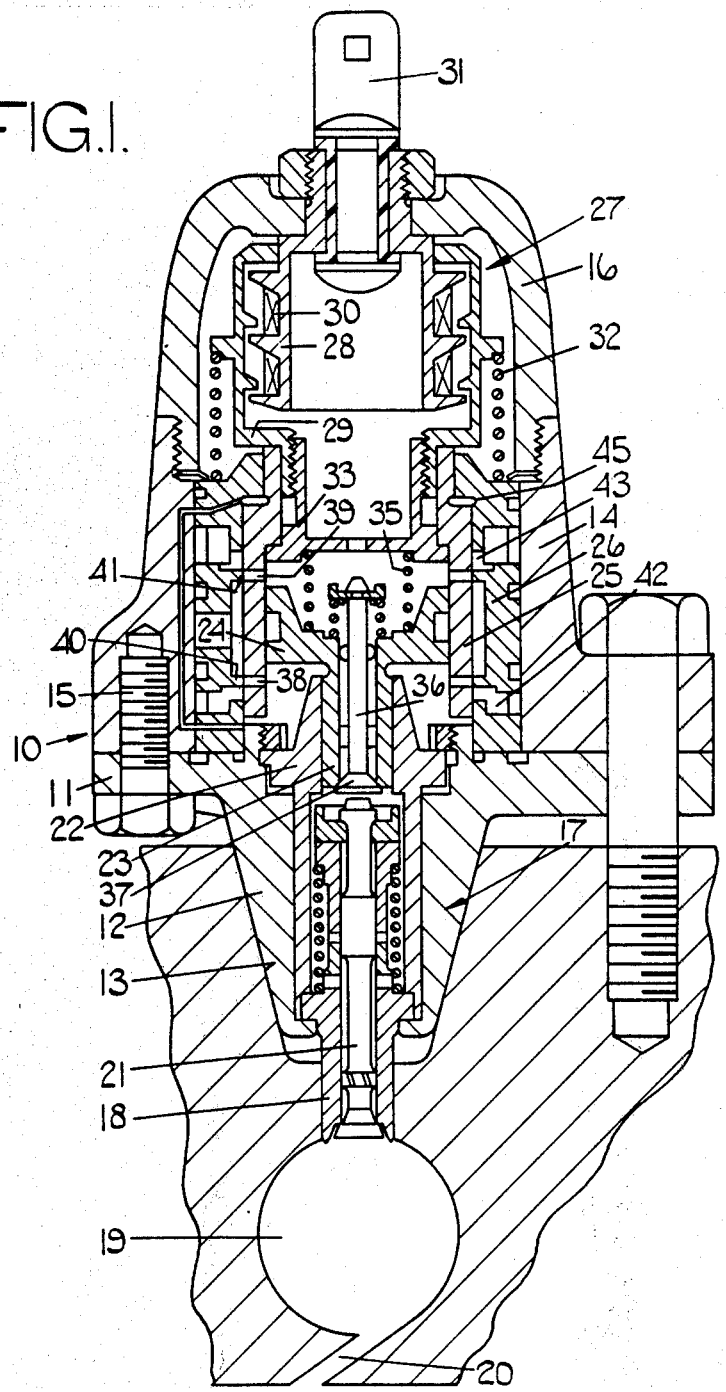
FIG. 1 is a sectional side elevation of the apparatus whilst

Referring to FIG. 1 of the drawings the pumping apparatus comprises a multi-part body 10 including a base plate 11 from which extends a tapered portion 12 which in use, is arranged to locate within a complementary bore 13 formed in the cylinder head of an engine. The body also includes an annular portion 14 which is secured to the plate 11 by means of a plurality of bolts 15. The annular portion 14 has an internal thread at its end remote from the plate 11, to receive an end closure 16.

The portion 12 of the body defines a cylindrical chamber within which is located an injection nozzle assembly 17. The assembly includes a flanged nozzle body 18 which projects beyond the end of the portion 13 through an aperture of reduced diameter in the cylinder head so that fuel flowing through the nozzle assembly is directed into a combustion chamber 19 of the engine. The construction of the nozzle assembly is well known but sufficient to say it includes an outwardly movable valve member 21 having a head co-operating with a seating and a return spring which loads the head into contact with the seating.

The plate 11 is provided with a recess about the chamber in the portion 13 and the recess accommodates the flange of a pump barrel 22 the flange of the barrel being engaged by a retaining ring. The barrel has a hollow cylindrical extension which acts to maintain the flange of the body 18 of the nozzle assembly, in engagement with a step defined in the chamber defined in the part 12.

Mounted within the pump barrel 22 is a plunger 23 and this is integrally formed with a piston 24 which is of larger diameter than the plunger and which is slidably located within a sleeve 25. The sleeve 25 is itself slidable within a further sleeve 26 one end of which is retained against the plate 11 by the pressure exerted by a spring washer trapped between the end closure 16 and a face defined by the annular body portion 14. The sleeves 25 and 26 constitute valve means for controlling the application of fluid under pressure to the surfaces on the opposite sides of the piston 24.

Housed within the end closure is an electrically controlled actuating means generally indicated at 27 and which includes a stator assembly 28 and an axially movable armature 29. The stator assembly carries electrical windings 30 to which electric current can be supplied by way of a terminal piece 31 and when electric current is supplied to the windings ribs on the stator assembly become magnetically polarised adjacent ribs having opposite magnetic polarity. The armature 29 surrounds the stator assembly and has complementary ribs. The ribs on the armature and stator assembly overlap so that when the windings are supplied with electric current the magnetic flux causes the opposed faces of the ribs to move towards each other so that as shown in the drawing, the armature 29 moves downwardly. A coiled compression spring 32 is provided to bias the armature in the upwards direction as seen in FIG. 1. A more comprehensive description of one form of actuating means can be found in the specification of British Patent 1,504,873.

The armature at its lower end has a hollow boss portion on the internal periphery of which are formed screw threads which are engaged with external threads formed on a sleeve-like connecting member 33, this is provided with an external flange which engages with a step defined on the internal peripheral surface of the sleeve 25 so that the sleeve 25 is secured to the armature 29 so as to move axially therewith.

Interposed between the sleeve-like connector member 33 and the piston 24 is a coiled compression spring 35. Moreover, formed in the plunger 23 is an axial bore which accommodates an inlet valve in the form of a valve member 36. The valve member 36 has a head 37 which co-operates with a seating defined about the bore in the plunger and at the end thereof facing the nozzle assembly. The head is biassed into contact with the seating by means of a spring.

The sleeve 25 is provided with two axially spaced series of ports 38, 39. These ports are positioned so as to lie beyond the extremes of travel of the piston 24. Flow of fluid through the ports 38, 39 is controlled by the further sleeve 26 and as shown in FIG. 1, this will be observed to define a pair of axially spaced lands 40, 41 of a width such that they can obturate the respective ports when the further sleeve is in an intermediate position. The groove defined between the lands is connected as will be explained, to a source of fluid (fuel) at a low pressure. Moreover, on the opposite sides of the lands 40, 41 are defined grooves 42, 43 which communicate with annular grooves formed in the external peripheral surface of the further sleeve. These grooves each communicate with a source of fluid (fuel) at high pressure. As will be seen from FIG. 2, the space within the end closure communicates with the low pressure source of fluid by way of a restrictor 44 whilst the annular space 45 which is of variable volume depending upon the position of the sleeve 25 and which is defined between the sleeves 25 and 26, communicates with the space defined beneath the piston 24 so that the sleeve is substantially pressure balanced.

In operation and starting from the position shown in FIG. 1, if the windings 30 are de-energised. This will permit the armature 29 to move upwardly quickly under the action of the springs 32 and 35. Such upward movement will also be imparted to the sleeve 25 and this will have the effect of placing the port 39 in communication with the groove 43 and therefore with the source of fluid at high pressure. Moreover, the port 38 will be exposed to the groove defined between the lands 40 and 41 which is at low pressure. Thus the upper surface of the piston 24 will be subjected to a high pressure whilst the lower surface will be subject to the lower pressure. The piston 24 will therefore move downwardly and such movement will be imparted to the plunger 23 so that fuel will be delivered to the injection nozzle and from the injection nozzle will flow in atomised form, into the combustion chamber 19. The movement of the piston and plunger is halted by mechanical engagement of the piston with the pump barrel 22. The piston and plunger will remain in this position so long as the windings 30 are de-energised. If now the windings are energised, a force will be imparted to the armature which will move downwardly to a position a which the force acting on the armature is balanced by the force exerted by the springs 32 and 35. Such movement will also move the sleeve 25 downwardly beyond the intermediate position shown to place the ports 38 in restricted communication with the groove 42 and the ports 39 in restricted communication with the groove disposed between the lands 40 and 41. The fluid pressures applied to the piston 24 are therefore reversed and the piston will move upwardly together with the plunger 23. The differential pressure causes the head 37 to be lifted from the seating of the plunger to admit fuel into the space below the plunger. As the piston moves upwardly the force exerted by the spring 35 on the connecting sleeve 33 increases and this force acts against the magnetic force created by the current flowing in the windings. As the force exerted by the spring 35 increases the armature will be moved upwardly as also will the sleeve 25 until a point is reached at which the ports 39 and 38 are closed by the lands 41 and 40. Once this has occurred no further movement of the piston and plunger can take place. The extent of movement of the piston and plunger is determined by the force produced by the electric current flowing in the windings 30 and hence by varying the magnitude of the current, the position of the piston 24 and the plunger 23 at the end of the filling stroke of the apparatus can be varied.

Figure 2:
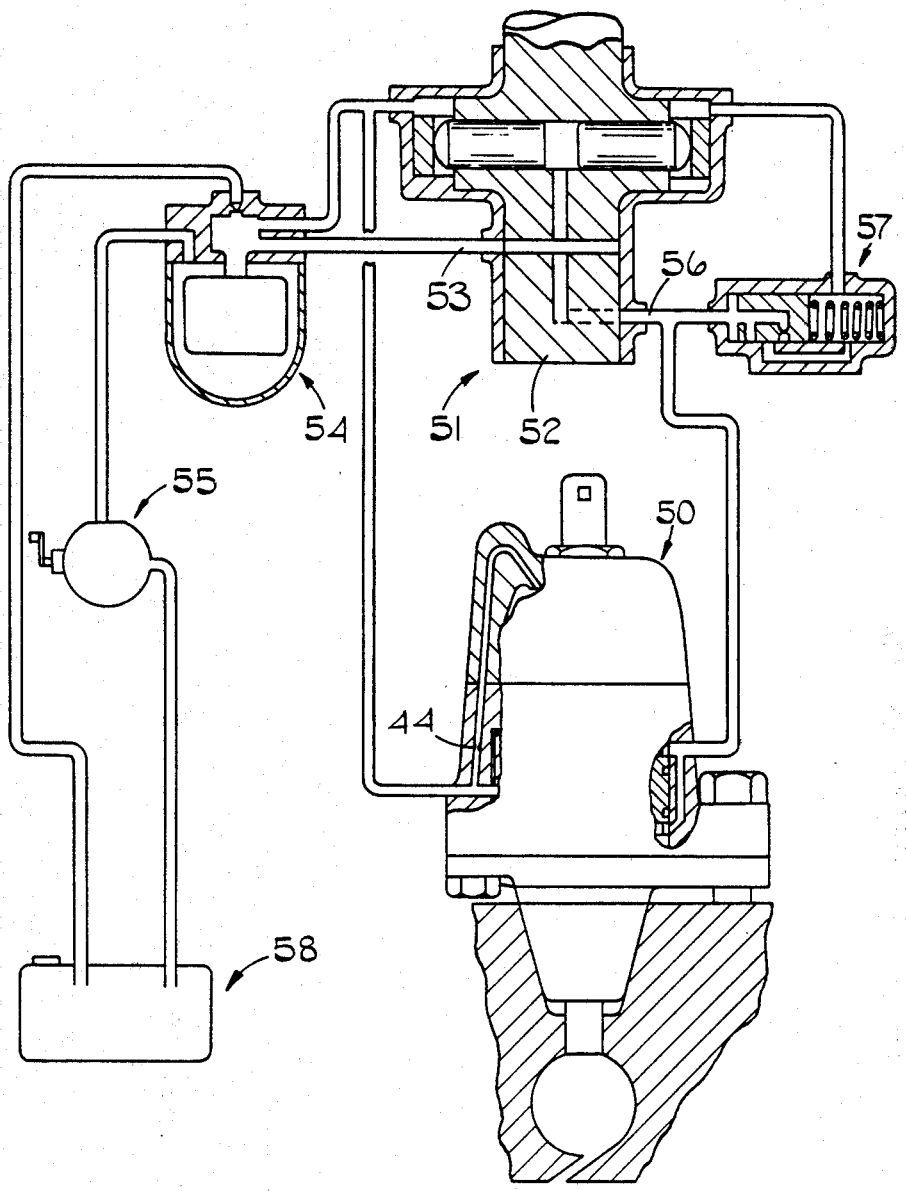
FIG. 2 shows the apparatus of FIG. 1 to a reduced scale, but it also illustrates the various additional components to form an engine fuel system.

Turning now to FIG. 2 the apparatus as described is shown generally at 50. The fluid under pressure for actuating the piston 24 is obtained from a pump 51 which as shown is of the rotary distributor type. It includes a rotor 52. Fuel is supplied to the pump through an inlet 53, this fuel being supplied through a filter unit 54 by means of an engine driven pump 55. The pump 51 has an outlet 56 which is in communication with the grooves 42 and 43 and the pressure at the outlet 56 is controlled by a valve 57 which also acts as an accumulator for the fuel. The filter unit is provided with a restricted bleed through which air and fuel can return to the fuel tank 58. The pump 52 can be driven in timed relationship with the associated engine but it should be remembered that the fuel under pressure supplied by the pump must be available for a substantial portion of the engine operating cycle.

It will of course be appreciated that the pump 51 may have some other form. The restrictor 44 allows a bleed of fuel from the end closure when fuel under pressure is applied to the upper side of the piston 24. Any air entrained with the fuel and tending to collect in the end closure will flow through the restrictor and will be returned to the filter.

It will be understood that the pressure supplied to the nozzle assembly will be higher than the pressure determined by the valve 57 in view of the difference in the areas of the piston 24 and plunger 23.

I claim:

1. A fuel pumping apparatus for supplying fuel under pressure to a fuel injection nozzle of an internal combustion engine comprising a plunger reciprocable within a bore, a piston connected to the plunger and of larger diameter than the plunger, valve means operable to apply a fluid under pressure to one surface of the piston to effect movement of the piston and the plunger thereby to cause fuel contained within the bore to be delivered to the injection nozzle, and electrically controlled actuating means for the valve means characterised in that the piston is constructed as a double acting piston and the valve means is movable from an intermediate position in which the supply of fluid under pressure to the opposite ends of the cylinder containing the piston is prevented, towards one or other operating positions in which fluid under pressure is supplied to one end of the cylinder and allowed to escape from the other end of the cylinder and vice versa, the apparatus further comprising resilient means acting between the piston and an output member of the actuating means, the arrangement being such that the extent of the return movement of the piston and plunger following delivery of fuel, is determined by the force generated by the actuating means and which is at least in part, opposed by the force exerted by the resilient means.

2. An apparatus according to claim 1 including further resilient means acting between the output member of the actuating means and a fixed part of the apparatus.

3. An apparatus according to claim 2 in which said cylinder is defined by a first sleeve movable within a second sleeve which is fixed within the apparatus, said first sleeve being connected to so as to be movable with said output member, said first and second sleeves constituting said valve means.

4. An apparatus according to claim 1 including further valve means operable to allow flow of fuel to said bore during the return movement of the piston and plunger.

5. An apparatus according to claim 4 in which said further valve means comprises a valve member located within a passage extending through the plunger, said valve member including a head engageable with a seating defined about said passage and resilient means urging said head into contact with the seating, said head being lifted from the seating by the differential pressure during the return movement of the plunger.

6. An apparatus according to claim 5 in which the passage in the plunger communicates with the side of the piston remote from the plunger.

* * * * *